US006904729B1

(12) United States Patent
Shroyer

(10) Patent No.: US 6,904,729 B1
(45) Date of Patent: Jun. 14, 2005

(54) SYSTEM FOR FACILITATING THE TEMPORARY HANGING OF OBJECTS FROM VINYL OR ALUMINUM SIDING WITHOUT DAMAGING THE SIDING

(75) Inventor: Lawrence R. Shroyer, Gloucester, VA (US)

(73) Assignee: Imagination Lane, Inc., Gloucester, VA (US)

( * ) Notice: Subject to any disclaimer, the term of this patent is extended or adjusted under 35 U.S.C. 154(b) by 93 days.

(21) Appl. No.: 10/664,471

(22) Filed: Sep. 17, 2003

(51) Int. Cl.[7] ..... E04G 00/01

(52) U.S. Cl. ..... 52/510; 52/DIG. 1; 52/749.1; 52/518

(58) Field of Search ..... 52/510, DIG. 1, 52/749.1, 748.1, 518; 29/91, 278; 248/301, 248/304, 48.2

(56) References Cited

U.S. PATENT DOCUMENTS 1,538,329 A * 5/1925 Honigbaum ..... 52/546
1,556,649 A * 10/1925 Topping ..... 52/105
1,963,632 A * 6/1934 Smith ..... 29/91
2,576,262 A * 11/1951 Morehead ..... 29/278
3,016,996 A * 1/1962 Smathers et al. ..... 52/204.5
4,009,743 A * 3/1977 Ackerman ..... 81/45
4,926,611 A * 5/1990 Funaki ..... 52/748.1
5,357,730 A * 10/1994 Pickeral ..... 52/749.1
5,575,132 A * 11/1996 Garsjo ..... 52/749.12
6,131,361 A * 10/2000 Murphy ..... 52/712
6,446,401 B1 * 9/2002 Krupp ..... 52/127.5

* cited by examiner

*Primary Examiner*—Basil Katcheves
(74) *Attorney, Agent, or Firm*—Peter J. Van Bergen

(57) ABSTRACT

A system is provided for facilitating the temporary hanging of at least one object from vinyl or aluminum siding while maintaining the integrity of the siding during and after the use thereof. The system comprises a hanger and a removal tool. The hanger has an upper portion designed to non-destructively be engaged between two rows of siding. The lower portion of the hanger provides the means to support the hanging of at least one object therefrom. The removal tool is designed for non-destructive cooperation with the upper portion of the hanger when the hanger is installed between two rows of vinyl or aluminum siding.

20 Claims, 6 Drawing Sheets

SYSTEM FOR FACILITATING THE TEMPORARY HANGING OF OBJECTS FROM VINYL OR ALUMINUM SIDING WITHOUT DAMAGING THE SIDING

FIELD OF THE INVENTION

The invention relates generally to hanging systems and the removal thereof, and more particularly to a system that facilitates the temporary hanging of objects from vinyl or aluminum siding without damaging the siding during and after the use thereof.

BACKGROUND OF THE INVENTION

More and more, homes and other buildings have their exteriors clad in either aluminum or vinyl siding. The advantages of such sidings include their attractive looks, low maintenance, weathertight integrity, low cost, and the fact that no routine exterior painting is required. Unfortunately, there are several disadvantages associated with vinyl or aluminum siding. Most notably, it is difficult to affix various fixtures and decorations to a building clad with such siding without piercing the siding (e.g., using screws, nails, etc.) or attaching something directly to the siding using an attachment material (e.g., adhesive, epoxy, tape, etc.). However, piercing the siding compromises the weathertight integrity of the siding so that the elements can reach the building's underlying structure, leaves unsightly holes in the siding should it be necessary to move or remove the external fixture, and leaves holes that are not easily repaired. Accordingly, the usual repair for pierced siding is to replace the pierced section with new siding even though it may be difficult or impossible to procure the exact replacement for the pierced siding or to match the color of the siding which has faded due to exposure to the elements.

While the use of attachment materials such as adhesives, epoxies, tape, etc., protects the integrity of the underlying building structure, these forms of attachment are prone to failure in outdoor environments. Furthermore, there is typically a residue left on the siding when the attachment material is removed. The residue can be difficult to remove and the removal process can aesthetically damage the siding.

SUMMARY OF THE INVENTION

Accordingly, it is an object of the present invention to provide a system that facilitates the hanging of object(s) from vinyl or aluminum siding while maintaining the siding's appearance and integrity both during and after the use thereof.

Other objects and advantages of the present invention will become more obvious hereinafter in the specification and drawings.

In accordance with the present invention, a system is provided for facilitating the temporary hanging of at least one object from vinyl or aluminum siding while maintaining the integrity of the siding during and after the use thereof. The system comprises a hanger and a removal tool. The hanger has an upper portion and a lower portion with the upper portion being defined by a substantially planar portion with a lip formed along a first edge thereof. The lower portion is coupled to a second edge of the substantially planar portion where the second edge opposes the first edge. The lower portion also including means for supporting the hanging of at least one object therefrom. The removal tool is designed for cooperation with the upper portion of the hanger when the hanger is installed between two panels or rows of vinyl or aluminum siding. The removal tool has (i) a hand grip, (ii) a stop block coupled to the hand grip and with the stop block terminating in a planar region, and (iii) a wedge having a base coupled to the stop block along a portion of the planar region. The remainder of the planar region adjacent the wedge's base is exposed and forms a stop that engages the siding when the removal tool is used to disengage the hanger from it's installation between two rows of vinyl or aluminum siding.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
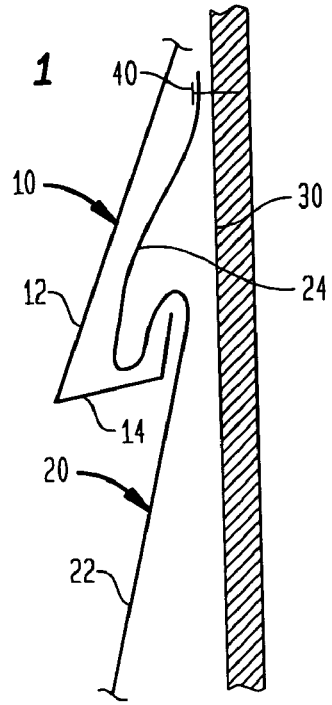
FIG. 1 is a side schematic view of the interface between two panels or rows of conventional vinyl or aluminum siding attached to a wall structure.
Figure 2:
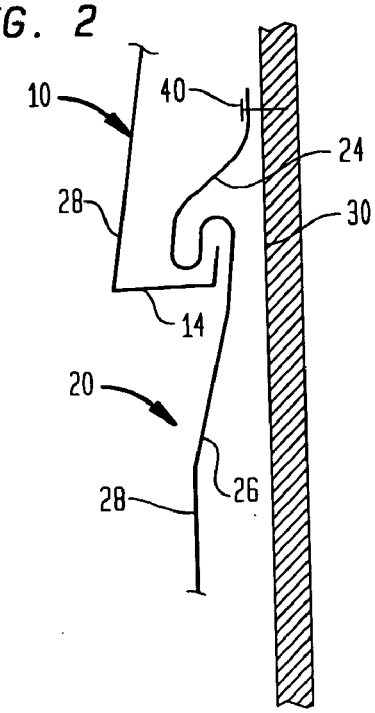
FIG. 2 is a side schematic view of the interface between two panels or rows of Dutch-lap vinyl or aluminum siding attached to a wall structure.

Referring now to the drawings and more particularly to FIGS. 1 and 2, the interface between two individual panels or rows (as they will be referred to hereinafter) of conventional vinyl or aluminum siding (FIG. 1) and Dutch-lap vinyl or aluminum siding (FIG. 2) are illustrated. It is to be understood that although the types of siding configured as shown in FIGS. 1 and 2 are generally made from vinyl or aluminum, this is not a limitation of the present invention. That is, the material used to construct the siding could be another manufactured material or composite without impacting the effectiveness of the present invention. The system of the present invention can be used in conjunction with either of the FIG. 1 or FIG. 2 siding configurations as will be explained further below. It is to be further understood that the present invention can also be used with custom or beaded types of siding and insulated foam-backed types of siding as their row interfaces are similar to that described above.

As is known in the art, the conventional siding configuration shown in FIG. 1 has an upper row 10 of siding and a lower row 20 attached to a wall structure 30. Upper row 10 includes a face 12 and an L-shaped return leg 14 that extends toward wall structure 30 from the lower portion of face 12. Lower row 20 includes a face 22 that extends below return leg 14, and a nail strip loop 24 that engages return leg 14 and provides a surface through which a nail 40 (or other similar fastener) is driven to couple lower row 20 to wall structure 30. This structure is repeated throughout a siding installation.

The Dutch-lap configuration illustrated in FIG. 2 is similar to the conventional siding shown in FIG. 1 with the exception that the face of each of upper row 10 and lower row 20 has an upper face 26 and a lower face 28 (with only lower face 28 of upper row 10 being visible in the drawing). Upper face 26 angles away from wall structure 30 more sharply than face 22 (FIG. 1) and lower face 28 extends substantially vertically downward from upper face 26.

Figure 12:
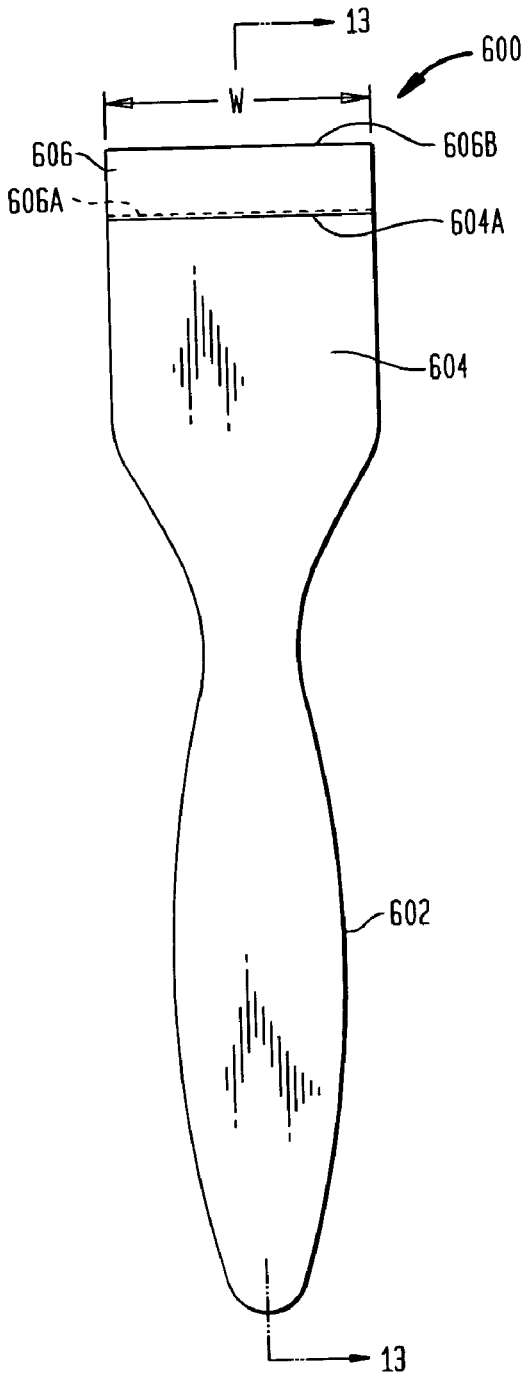
FIG. 12 is a plan view of an embodiment of a removal tool used in the system of the present invention.
Figure 13:
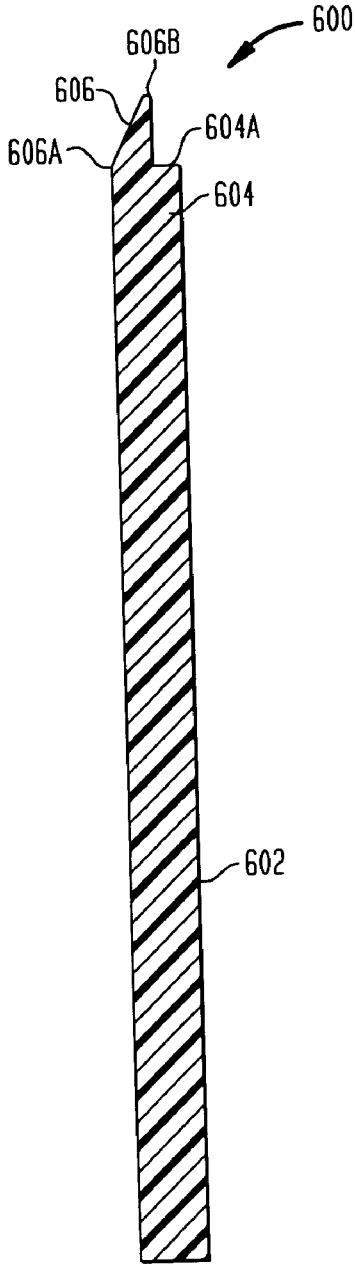
FIG. 13 is a cross-sectional view of the removal tool taken along line 13—13 in FIG. 12.

In general, the structure of the present invention includes a hanger (e.g., several embodiments of which are depicted in FIGS. 3–5 and 7–9) and a removal tool (e.g., FIGS. 12–13). Each of the hangers and removal tool can be made from a variety of well-known materials such as plastics or composites that will not mar the siding with which it will come in contact. Each hanger is designed to be securely attachable to the siding without the use of any fasteners and without damaging the siding. Once in place, each of the hangers serves as a point of hanging or attachment for a variety of fixtures, decorations, etc. Further, removal of each of the hangers is facilitated by using the removal tool whereby such removal is accomplished without any damage or alteration of the siding. Thus, the present invention provides the means to hang object(s) from siding while maintaining the structural and finish integrity of the siding both during and after use of the system of the present invention.

Figure 3:
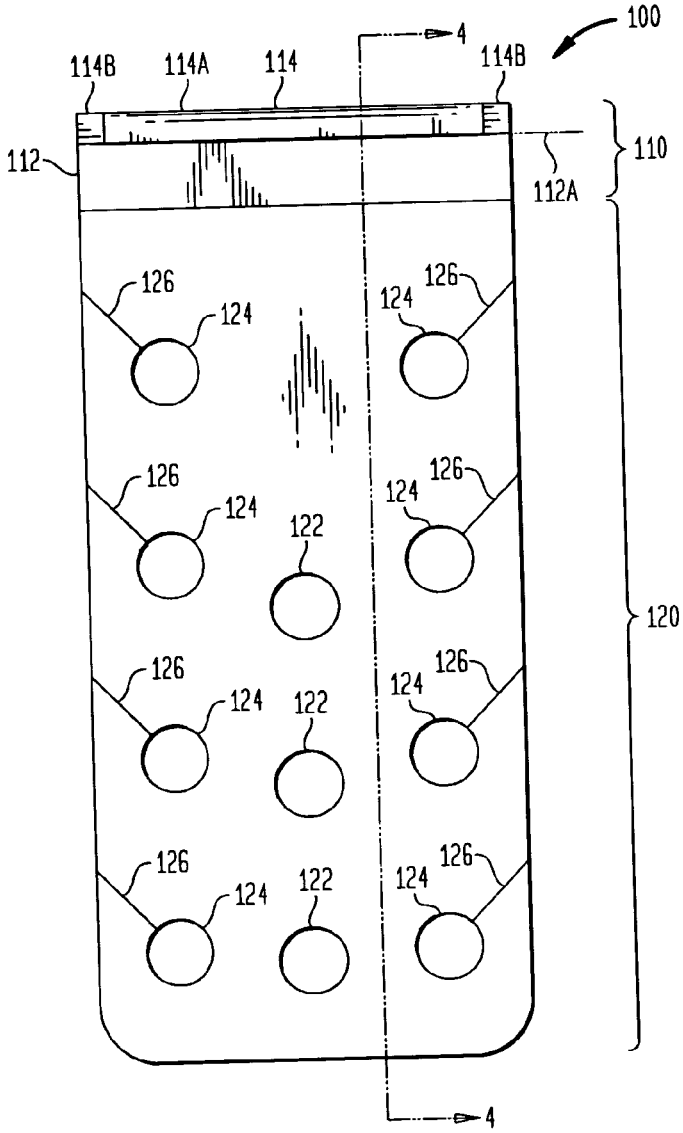
FIG. 3 is a plan view of one embodiment of a hanger used in the system for facilitating the hanging of object(s) from vinyl or aluminum siding in accordance with the present invention.
Figure 4:
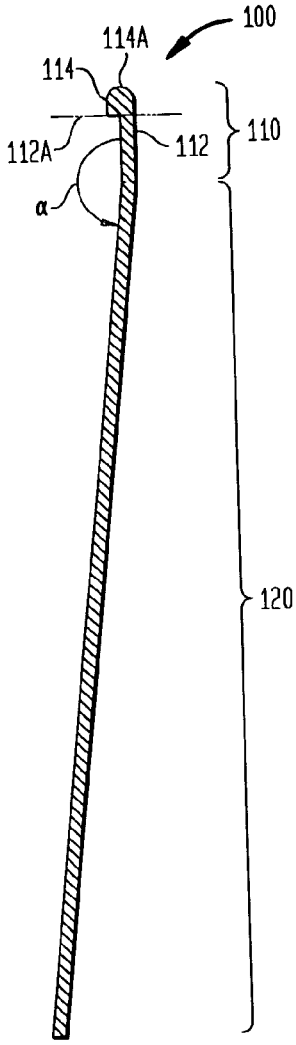
FIG. 4 is a cross-sectional view of the hanger taken along line 4—4 in FIG. 3.

Referring simultaneously now to FIGS. 3 and 4, a first embodiment of a hanger is shown and referenced generally by numeral 100. Hanger 100 is a one-piece hanger having an upper portion 110 and a lower portion 120. Upper portion 110 provides hanger 100 the means to be inserted between and supported by the interface between two rows of siding. Lower portion 120 provides hanger 100 the means to support the hanging of one or more objects therefrom.

Upper portion 110 is defined by a flat or planar region 112 and a lip 114. More specifically, lip 114 extends along and protrudes from one edge (indicated by dashed line 112A) of planar region 112. Lip 114 is typically shaped (e.g., rounded, tapered, etc.) along its top 114A to facilitate insertion thereof between a return leg and nail strip loop of two interfacing rows of siding as will be explained further below. Lip 114 can also be beveled at either end 114B towards the front portion of upper portion 110 as shown to facilitate the insertion (leading with either end 114B) of hanger 100 between two rows of siding.

Lower portion 120 has a number of holes formed therethrough that can be used to support the hanging of object(s) therefrom. For example, holes 122 in the central region of lower portion 120 can be used individually or in combination to hang an object using string, wires, etc. Holes 124 in the edge regions of lower portion 120 can be used in a similar fashion. In addition, lower portion 120 can have areas (e.g., lines 126) of structural weakness that lead from the edge of lower portion 120 to one of holes 124. One or more of the structurally weak lines 126 can be manipulated to failure or cut so that a path is defined to the corresponding one of holes 124. In this way, lower portion 120 can be used to dress wires (e.g., television, telephone, etc.), or ropes (e.g., flag pole lines, sign hanging ropes, etc.) that must be run on the exterior of a house or building. The areas or lines 126 of structural weakness can be formed by scoring lower portion 120. If hanger 100 is made from plastic, lines 126 can be configured as what is known in the art of plastics manufacturing as a "living hinge".

Upper portion 110 and lower portion 120 can be aligned with one another in the same general plane or can be angularly disposed with respect to one another as shown. By angularly disposing the two portions with respect to one another, hanger 100 can securely engage either the conventional siding (FIG. 1) or Dutch-lap siding (FIG. 2) as will be explained further below. To achieve such versatility, it has been found that the angle $\alpha$ between upper portion 110 and lower portion 120 should be in the approximate range of 165–175°.

Figure 5:
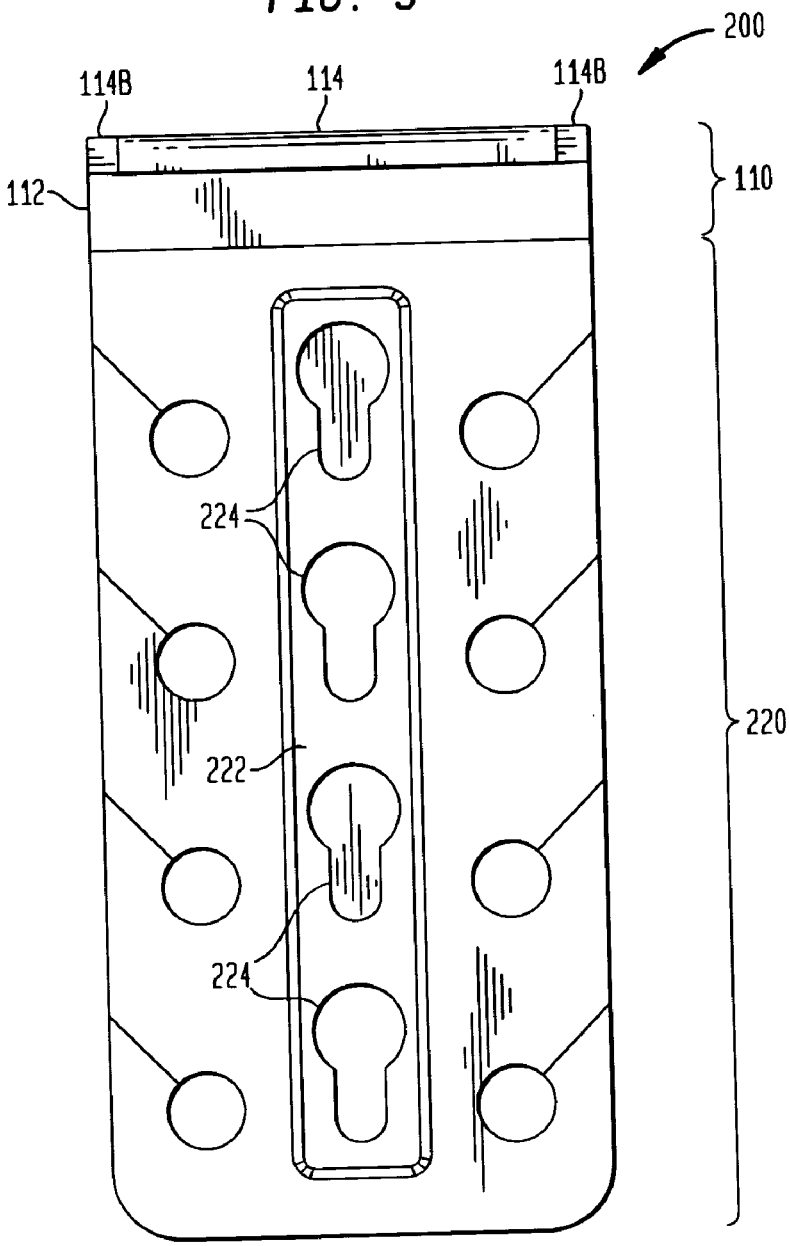
FIG. 5 is a plan view of another embodiment of a hanger for use in the system of the present invention where the hanger includes keyholes.
Figure 6:
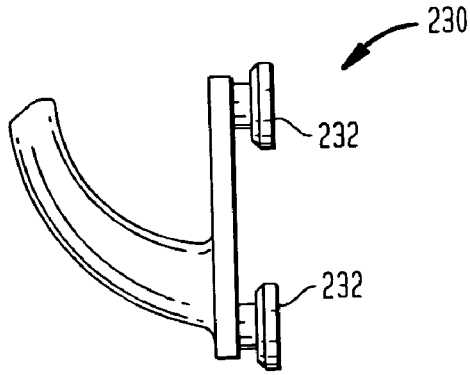
FIG. 6 is a side view of a hook having posts configured for cooperation with two of the keyholes in the hanger shown in FIG. 5.

Another embodiment of a suitable hanger for use in the system of the present invention is illustrated in FIG. 5 and is referenced generally by numeral 200 with common reference numerals being used for those elements that are identical to that of hanger 100. The difference in hanger 200 is a lower portion 220. Specifically, a raised central region 222 has a plurality of keyholes 224 formed therethrough. Keyholes 224 serve as the mounting point for a dependent support such as hook 230 illustrated in FIG. 6. Hook 230 has at least one post 232 (e.g., two are shown) designed to cooperate with corresponding one (or more) of keyholes 224 as is well understood in the art. It is to be further understood that other dependencies (e.g., rod, eye, etc.) could be supported using one or more of keyholes 224 without departing from the scope of the present invention.

Figure 7:
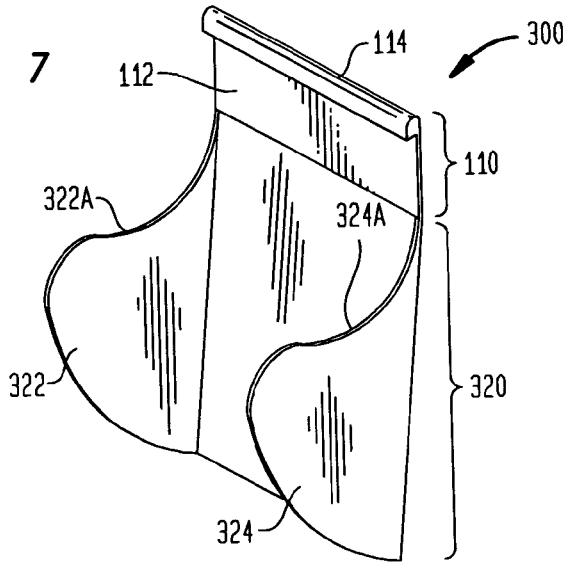
FIG. 7 is a perspective view of another embodiment of a hanger in which bracket arms are integral therewith.

Still another embodiment of a suitable hanger is illustrated in FIG. 7 and is referenced generally by numeral 300. Lower portion 320 of hanger 300 is configured with bracket arms 322 and 324. Bracket arms 322 and 324 are typically integrally formed as part of lower portion 320. Bracket arms 322 and 324 have respective tops 322A and 324A aligned and shaped to cradle an object (e.g., a rod) thereon.

Figure 8:
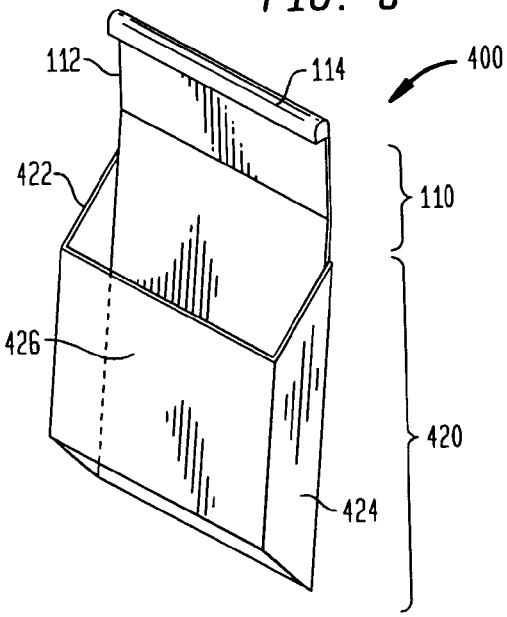
FIG. 8 is a perspective view of another embodiment of a hanger in which a mounting region can be offset with respect to the siding.

The hanger used in the system of the present invention could also be configured as shown in FIG. 8. Hanger 400 has its lower portion 420 formed with integral support arms 422 and 424 and an offset mounting region 426 spanning arms 422 and 424. Mounting region 426 would thus be offset from the siding to which hanger 400 would be secured.

Figure 9:
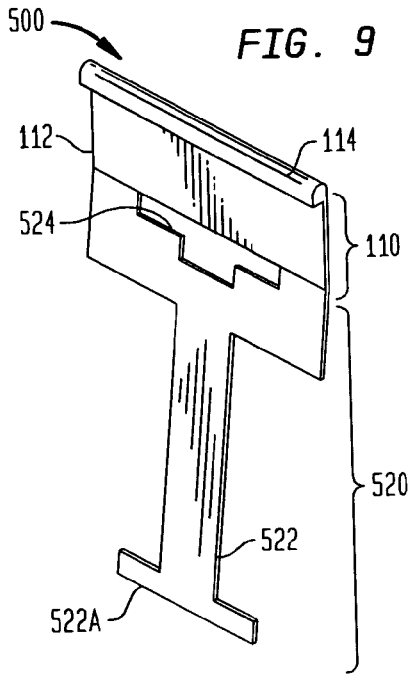
FIG. 9 is a perspective view of another embodiment of a hanger configurable to define a hanging loop.

In FIG. 9, hanger 500 has a lower portion 520 configured to be assembled into a hanging loop. For example, a T-portion 522 can be shaped so that a top 522A thereof is fitted into and then locked within a T-slot 524. Such locking is secured when an object would be hung in the resulting loop. Other types of loop-forming constructions could be used without departing from the scope of the present invention.

Figure 10:
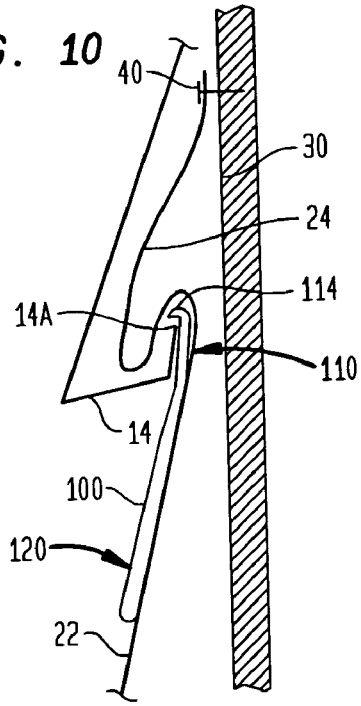
FIG. 10 is a side view of conventional siding with a hanger installed in accordance with the present invention.
Figure 11:
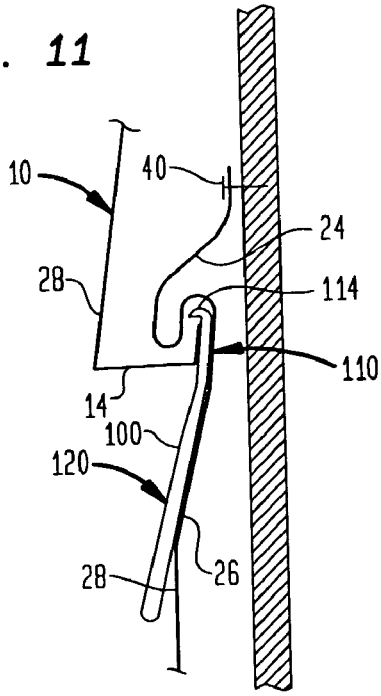
FIG. 11 is a side view of Dutch-lap siding with a hanger installed in accordance with the present invention.

As is evident from the above descriptions of the various hanger embodiments, the upper portion of each hanger is identical. Accordingly, an installation description for one hanger embodiment (e.g., hanger 100) will suffice for all hanger embodiments. Referring now to FIGS. 10 and 11, hanger 100 is shown installed between two rows of conventional and Dutch-lap siding, respectively. For each type of installation, upper portion 110 of hanger 100 is pushed up between return leg 14 and nail strip loop 24 until lip 114 engages the top edge 14A of return leg 14. The existing fit and flex of the siding keeps lip 114 engaged with return leg 14. If configured with an angular relationship between upper portion 110 and 120, this angular relationship allows lip 114 to remain engaged with return leg 14 in the Dutch-lap siding configuration (FIG. 11). Specifically, lower portion 120 can follow the sharper angle of face 26 while upper portion 110 remains substantially vertical thereby keeping lip 114 engaged with return leg 14. In either installation, hanger 100 is securely held in place without damaging the siding and while providing a platform i.e., lower portion 120) for the hanging of object(s) therefrom.

As mentioned above, the system of the present invention includes a tool that facilitates the removal of each of the above-described hangers from between two rows of siding while maintaining (i) the structural integrity of the siding, (ii) the appearance of the siding, and (iii) the integrity of the interface between the two rows of siding from which the hanger is being removed. In this way, the present invention maintains the siding's structure and appearance both during and after the use thereof.

One embodiment of such a removal tool is shown in FIGS. 12 and 13 and is referenced generally by numeral 600. By way of illustrative example, removal tool 600 is a one-piece tool (e.g., molded plastic or composite) that defines a hand grip 602, a block 604 extending from hand grip 602, and a wedge 606 extending from block 604. Hand grip 602 can be shaped in any suitable manner well known to those in the art of hand tools. Block 604 forms a planar region (referenced by dashed line 604A) having one side thereof that serves as the region of coupling with the base 606A of wedge 606. The other side of planar region 604A remains exposed and forms a stop during the use of removal tool 600. The apex 606B of wedge 606 can be positioned centrally over block 604 and along the length thereof. Note that when removal tool 600 is to be used with hanger designs such as those shown in FIGS. 7 and 8, the width W of block 604 and wedge 606 should be less than that of the hanger in order to fit between the arms that extend therefrom. However, in general, the width of block 604 and wedge 606 are not limitations of the present invention.

Figure 14A:
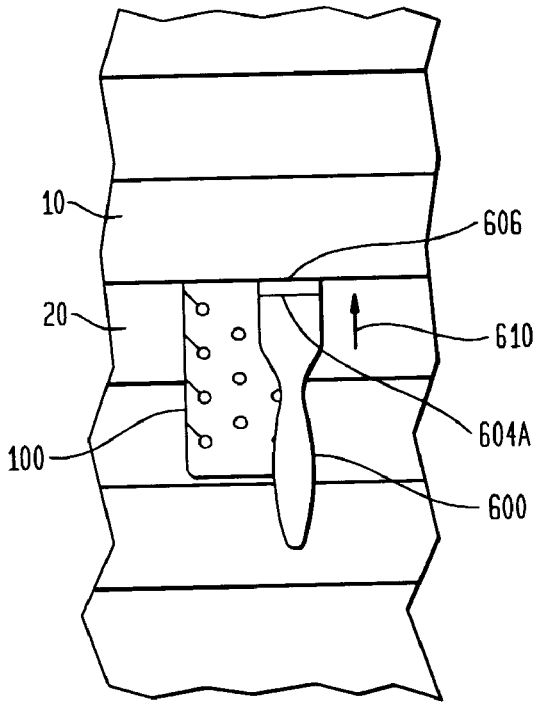
FIGS. 14A–14C depict the sequence of steps used to remove the hanger from its installation at the interface between two panels or rows of siding using the removal tool portion of the present invention.
Figure 14B:
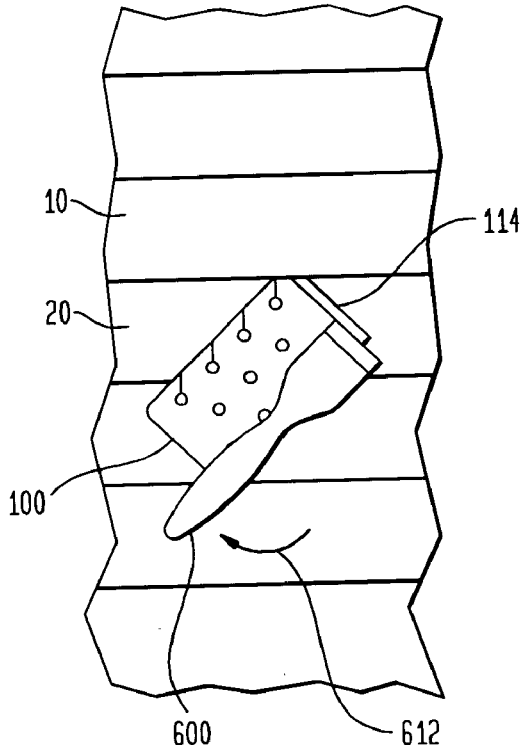
Figure 14C:
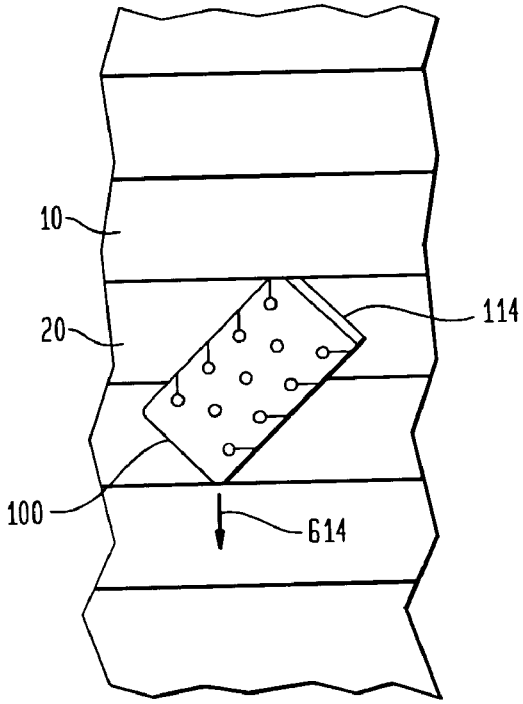

To explain the use and advantages of removal tool 600, continued reference will be made to FIG. 10 as well as the sequence of illustrations in FIGS. 14A–14C. With hanger 100 installed as shown in FIG. 10, removal tool 600 is placed against hanger 100 with wedge 606 thereagainst. Removal tool 600 is then pushed upwards as indicated by arrow 610 in FIG. 14A. In doing this, wedge 606 is driven up under the return leg (not shown in FIG. 14A) of upper row 10 until the stop defined by the exposed portion of planar region 604A contacts the return leg. At this point, the thickness of wedge 606 drives the return leg of upper row 10 outward from wall structure 30 just enough to disengage from lip 114. With lip 114 disengaged from the return leg of upper row 10, removal tool 600 and hanger 100 can be pulled/rotated downward as indicated by arrow 612 as shown in FIG. 14B until hanger 100 can be pulled straight downward as indicated by arrow 614 in FIG. 14C. Since the relationships between upper row 10 and lower row 20 are left essentially undisturbed during the removal process, the siding remains "zipped" together during the removal of hanger 100.

The advantages of the present invention are numerous. The system of hanger and removal tool provide the means to hang or support a wide variety of objects from a building clad in vinyl or aluminum siding. Installation, use and removal of the system will not damage the structure or appearance of the siding thereby protecting the siding as well as the underlying building structure.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A system for facilitating the temporary hanging of at least one object from vinyl or aluminum siding while maintaining the integrity of the siding during and after the use thereof, said system comprising:

a hanger having an upper portion and a lower portion, said upper portion defined by a substantially planar portion with a lip formed along a first edge thereof, said lower portion coupled to a second edge of said substantially planar portion, said second edge opposing said first edge, said lower portion including means for supporting the hanging of at least one object therefrom; and a removal tool for cooperation with said upper portion of said hanger, said removal tool including (i) a hand grip, (ii) a stop block coupled to said hand grip and terminating in a planar region, and (iii) a wedge having a base coupled to said stop block along a portion of said planar region wherein a remainder of said planar region adjacent said base is exposed.

2. A system as in claim 1 wherein said upper portion and said lower portion are angularly disposed with respect to one another.

3. A system as in claim 1 wherein said means for supporting includes a plurality of holes formed in said lower portion.

4. A system as in claim 3 further comprising at least one area of structural weakness in said lower portion that extends from an edge of said lower portion to one of said plurality of holes wherein said area of structural weakness can be manipulated to failure.

5. A system as in claim 3 wherein at least a portion of said plurality of holes are keyholes.

6. A system as in claim 5 further comprising a dependency having means for cooperating with at least one of said keyholes wherein said dependency is coupled to and extends from said lower portion.

7. A system as in claim 1 wherein said lip is shaped along its length wherein insertion of said upper portion of said hanger behind a return leg of the siding is facilitated.

8. A system for facilitating the temporary hanging of at least one object from vinyl or aluminum siding while maintaining the integrity of the siding during and after the use thereof, said system comprising:

a hanger having an upper portion coupled to a lower portion with said upper portion and said lower portion having an angle formed therebetween, said angle being between approximately 165–175°, said upper portion defined by a planar portion with a rounded lip formed along a first edge thereof, said lower portion coupled to a second edge of said planar portion, said second edge opposing said first edge, said lower portion including means for supporting the hanging of at least one object therefrom; and a removal tool for cooperation with said upper portion of said hanger, said removal tool including (i) a hand grip, (ii) a stop block coupled to said hand grip and terminating in a flat end, and (iii) a wedge having a base coupled to said stop block all along one side of said flat end wherein another side of said flat end adjacent said base is exposed.

9. A system as in claim 8 wherein the width of said stop block and said wedge is less than that of said hanger.

10. A system as in claim 8 wherein said means for supporting includes a plurality of holes formed in said lower portion.

11. A system as in claim 10 further comprising at least one line of structural weakness in said lower portion that extends from an edge of said lower portion to one of said plurality of holes wherein said line of structural weakness can be manipulated to failure.

12. A system as in claim 10 wherein at least a portion of said plurality of holes are keyholes.

13. A system as in claim 12 further comprising a dependency having means for cooperating with at least one of said keyholes wherein said dependency is coupled to and extends from said lower portion.

14. A system for facilitating the temporary hanging of at least one object from vinyl or aluminum siding while maintaining the integrity of the siding during and after the use thereof, said system comprising:

a hanger having an upper portion coupled to a lower portion with said upper portion and said lower portion having an angle formed therebetween, said angle being between approximately 165–175°, said upper portion defined by a planar portion with a rounded lip formed along and protruding from a first edge thereof, said lower portion coupled to a second edge of said planar portion, said second edge opposing said first edge, said lower portion including means for supporting the hanging of at least one object therefrom; and a one-piece removal tool for cooperation with said upper portion of said hanger, said removal tool defined by (i) a hand grip, (ii) a stop block extending from said hand grip and terminating in a flat end, and (iii) a wedge having a flat base and an apex with said flat base adjoining said stop block all along one side of said flat end wherein another side of said flat end adjacent said base is exposed, said apex being aligned over a central portion of said stop block.

15. A system as in claim 14 wherein the width of said stop block and said wedge is less than that of said hanger.

16. A system as in claim 14 wherein said means for supporting includes a plurality of holes formed in said lower portion.

17. A system as in claim 16 further comprising at least one line of structural weakness in said lower portion that extends from an edge of said lower portion to one of said plurality of holes wherein said line of structural weakness can be manipulated to failure.

18. A system as in claim 16 wherein at least a portion of said plurality of holes are keyholes.

19. A system as in claim 18 further comprising a dependency having means for cooperating with at least one of said keyholes wherein said dependency is coupled to and extends from said lower portion.

20. A system as in claim 14 wherein opposing ends of said rounded lip are beveled.

* * * * *